United States Patent [19]

Overgoor et al.

[11] Patent Number: 5,075,602

[45] Date of Patent: Dec. 24, 1991

[54] DISCHARGE LAMP CONTROL CIRCUIT ARRANGEMENT

[75] Inventors: Bernardus J. M. Overgoor; Adrianus M. J. De Bijl, both of Eindhoven, Netherlands

[73] Assignee: U.S. Philips Corporation, New York, N.Y.

[21] Appl. No.: 614,886

[22] Filed: Nov. 16, 1990

[30] Foreign Application Priority Data

Nov. 29, 1989 [NL] Netherlands ..... 8902940
May 31, 1990 [NL] Netherlands ..... 9001241

[51] Int. Cl.[5] ..... H05B 41/36

[52] U.S. Cl. ..... 315/307; 315/224; 315/209 R; 315/DIG. 7

[58] Field of Search ..... 315/307, 224, 209 R, 315/243, DIG. 5, DIG. 7; 363/109, 131, 97

[56] References Cited

U.S. PATENT DOCUMENTS 4,887,007 12/1989 Almering et al. ..... 315/307 X
4,952,842 8/1990 Bolhuis et al. ..... 315/DIG. 7 X

FOREIGN PATENT DOCUMENTS 059064 9/1982 European Pat. Off. .
265237 4/1988 European Pat. Off. .

*Primary Examiner*—Eugene R. LaRoche
*Assistant Examiner*—Ali Neyzari

[57] ABSTRACT

The invention relates to a circuit arrangement for operating a discharge lamp, comprising a DC-AC converter provided with switching elements and a drive circuit for rendering the switching elements alternately conducting. The circuit arrangement is furthermore provided with a control circuit C for controlling the power consumed by the lamp. To this end, the control circuit is coupled to a current sensor. According to the invention, the current sensor is so positioned that the power consumed by the lamp can be controlled independently of the build-up of the drive circuit and that a simple construction of the control circuit C is possible.

2 Claims, 1 Drawing Sheet

DISCHARGE LAMP CONTROL CIRCUIT ARRANGEMENT

Figure 1:
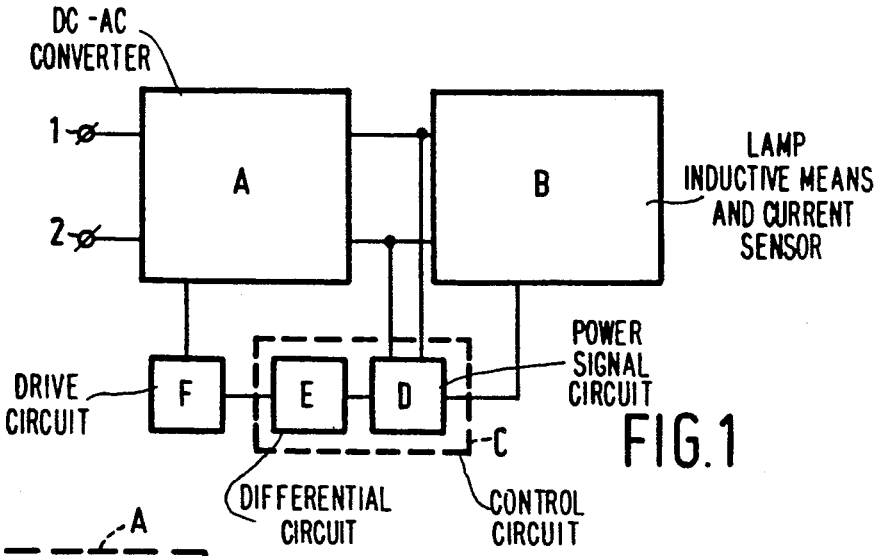

The invention relates to a circuit arrangement for operating a discharge lamp, comprising a DC-AC converter provide with a circuit A suitable for being connected to a DC voltage source, comprising two switching elements for generating a current with alternating polarity by being alternately conducting and non-conducting with a frequency f, a load circuit B comprising lamp connection terminals, inductive means, and ends which are each connected to a respective main electrode of one of the two switching elements in circuit A, a drive circuit F for generating a drive signal for rendering the switching elements alternately conducting and non-conducting with the frequency f, and a current sensor, and a control circuit C coupled to the current sensor and to the drive circuit F for controlling a power consumed by the lamp.

Such a circuit arrangement is known from the Netherlands Patent Application 8800015. The circuit A is provided with connection terminals for connection to the DC voltage source.

If a lamp is operated by means of the known circuit arrangement, a current J whose polarity changes with the frequency f flows through the load circuit B, while a substantially square-wave potential Vp is present between the ends of the load circuit B with a repetition frequency which is also equal to f.

The current sensor in the known circuit arrangement is included in circuit A as a connection between a connection terminal and a main electrode.

In the known circuit arrangement, firstly, the average value of the DC voltage present between the input terminals of the DC-AC converter is kept constant within narrow limits by means of a circuit portion of control circuit C, which is coupled to the connection terminals of the DC-AC converter. Secondly, another circuit portion of control circuit C measures the average value of the current through the sensor and controls it to a desired value. Control of the average value of the current through the sensor may take place by means of a change in the conduction time of one or both switching elements of circuit A or, alternatively, by changing the frequency f. A combination of the two is also possible. The control circuit C ensures the maintainance at a substantially constant level of the power consumed by the DC-AC converter and thus indirectly of the power consumed by the lamp by keeping constant both the average value of the voltage present between the input terminals and the average value of the current through the current sensor.

Since the current sensor is present in circuit A, currents in circuit A which do not flow through the load circuit B, such as, for example, control currents of the switching elements, will influence the operation of the control circuit C. This is disadvantageous since it introduces a systematic error into the power control of the lamp. The position of the sensor in such a case also leads to extra power losses in the control of the switching elements since part of the power derived from the drive circuit is dissipated in the current sensor.

The invention has for its object to provide a circuit arrangement in which the power consumed by the DC-AC converter can be controlled in a simple manner, while this power control is dependent exclusively on the current through the load circuit.

According to the invention, a circuit arrangement of the kind described in the opening paragraph is for this purpose characterized in that the current sensor forms part of the load circuit B and the control circuit C is furthermore coupled to the ends of the load circuit B.

These measures make it possible to control the power taken up in the load circuit B by means of the control circuit C. This also leads to a simplified construction of the control circuit C.

Preferably, the control circuit C is so designed that a first signal is generated therein which is a measure for the lamp power and is compared with a reference signal, which in its turn is a measure for the desired consumed power. The desired power may be adjustable in that case. The result of the comparison leads to a control signal with which the drive signal in the drive circuit F is so controlled that the power consumed by the lamp is substantially equal to the desired value.

A special embodiment of a circuit arrangement according to the invention is characterized in that the control circuit C comprises a multiplier circuit for generating a signal Q which is proportional to the product of an instantaneous value of a current through the current sensor and an accompanying instantaneous value of a voltage between the ends of the load circuit B, and a circuit for generating a signal which is proportional to an average value of the signal Q.

This embodiment of the control circuit C is thus provided with means for generating the first signal, which means can be realised in a very reliable manner and through the use of simple components.

A further special embodiment of a circuit arrangement according to the invention is characterized in that the current sensor is also coupled to means for preventing capacitive operation of the DC-AC converter. Capacitive operation is here understood to mean an operating condition in which the voltage across the load circuit lags behind the current through the load circuit. It is a characteristic of capacitive operation that each of the switching elements is made conducting at a moment at which the voltage across the relevant switching element is high. This leads to a comparatively high power dissipation in the switching elements, which usually adversely affects the lives of the switching elements.

Since a DC-AC converter can switch over from inductive operation to capacitive operation owing to a change in the drive signal, it is advantageous to combine a circuit arrangement according to the invention with means for preventing capacitive operation of the DC-AC converter.

The invention will be explained in more detail with reference to accompanying drawing of an embodiment thereof.

In the drawing

Figure 2:
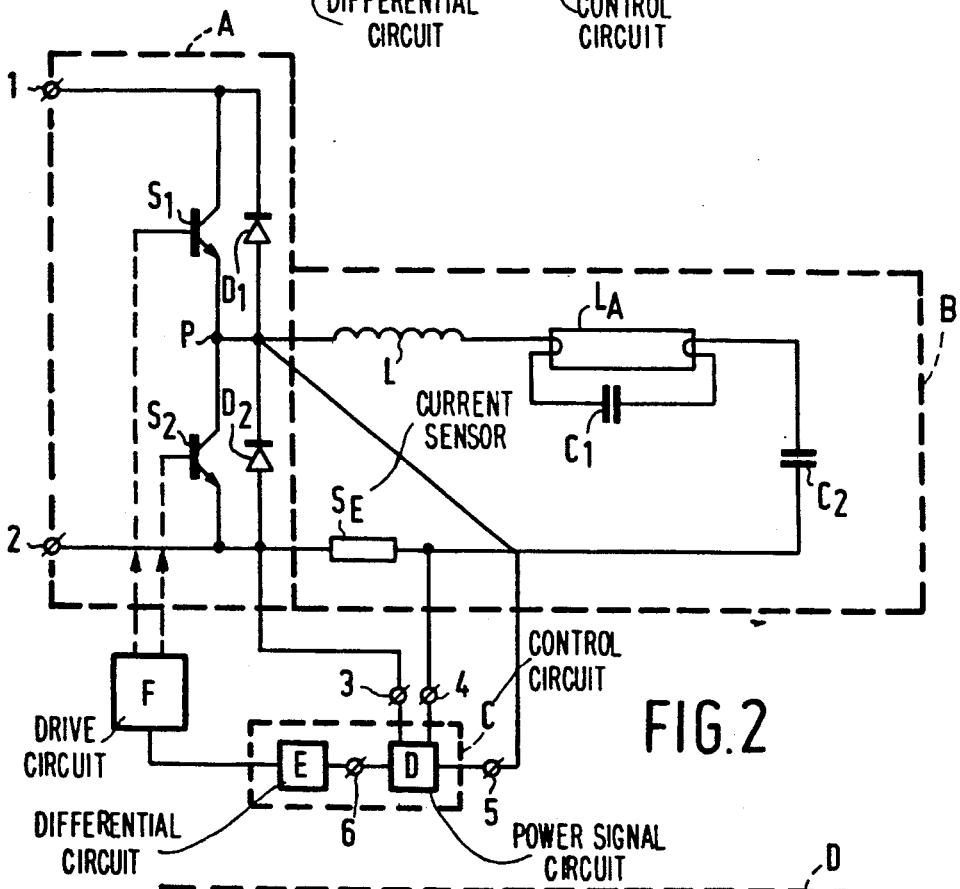
Figure 3:
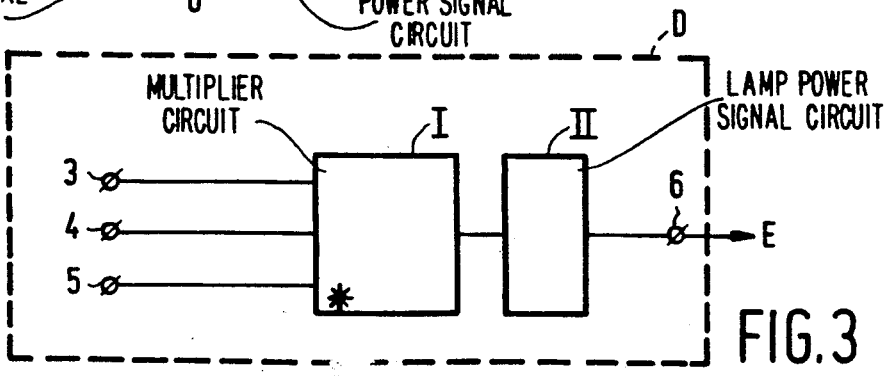

FIG. 1 is a diagrammatic representation of an embodiment of a circuit arrangement according to the invention, FIG. 2 shows in greater detail the embodiment shown in FIG. 1, and FIG. 3 shows a preferred embodiment of a portion of the control circuit C.

In FIG. 1, reference numerals 1 and 2 denote terminals suitable for being connected to poles of a DC voltage source. The terminals 1 and 2 are connected to ends of a circuit A, which comprises two switching elements. Each end of load circuit B, which comprises inductive means, lamp connection terminals, and a current sensor, is connected to a respective main electrode of one of the two switching elements of circuit A. A lamp is connected to the lamp connection terminals of load circuit B.

F is a drive circuit for generating a drive signal for making the switching elements of circuit A alternately conducting with a frequency f.

C is a control circuit for controlling a power consumed by the lamp. To this end, the circuit C is coupled to the current sensor and to ends of the load circuit B. These couplings are shown in FIG. 1. Control circuit C comprises a circuit D for generating a first signal which is a measure for the power consumed by the lamp. The control circuit C also comprises a circuit E for generating a control signal which is a measure of difference between the first signal and reference signal which in its turn is a measure for a desired value of the power consumed by the lamp. This control signal is present at an output of circuit E. This output is connected to an input of drive circuit F. Drive circuit F is connected to the switching elements of circuit A. Drive circuit F governs the conduction time of the switching elements and/or the frequency f with which the switching elements are made conducting and non conducting in dependence on the control signal. In this way the power consumed by the lamp is substantially equal to the desired value.

In FIG. 2, switching elements S1 and S2 and diodes D1 and D2 form the circuit A.

Load circuit B comprises a coil L, lamp connection terminals, capacitors C1 and C2, and a current sensor SE. The coil L in this embodiment forms the inductive means. A lamp La is connected to the lamp connection terminals.

Terminals 1 and 2 are interconnected by a series circuit of switching elements S1 and S2 in such a way that a main electrode of switching element S1 is connected to terminal 1 and a main electrode of switching element S2 to terminal 2. Switching element S1 is shunted by the diode D1 in that an anode of the diode D1 is connected to a common junction point P of the two switching elements S1 and S2. Switching element S2 is shunted by the diode D2 in that an anode of the diode D2 is connected to terminal 2.

Switching element S2 is also shunted by a series circuit of the coil L, the lamp La, the capacitor C2 and the current sensor SE, which in the embodiment shown in formed by a resistor. The lamp La is shunted by a capacitor C1.

An end of the current sensor SE coinciding with an end of the load circuit B is connected to an input 3 of the circuit D. A further end of the current sensor is connected to a further input 4 of the circuit D. A third input 5 of the circuit D is connected to the common junction point P of the two switching elements which coincides with a further end of the load circuit B. An output 6 of circuit D is connected to an input of circuit E, and an output of circuit E is connected to an input of drive circuit F. An output of the drive circuit F is connected to a control electrode of the switching element S1 and a second output of the drive circuit F is connected to a control electrode of the switching element S2.

The operation of the converter shown in FIG. 2 is as follows.

When the terminals 1 and 2 are connected to poles of a DC voltage source, the drive signal renders the switching elements S1 and S2 alternately conducting with a frequency f. Thus the common junction point P of the two switching elements is alternately connected to the negative and the positive pole of the DC voltage source. As a result, a substantially square-wave voltage Vp with a repetition frequency f is present at junction P. This substantially square-ware voltage Vp causes a current J, whose polarity changes with the repetition frequency f, to flow in circuit B. A phase difference exists between Vp and J which depends on the repetition frequency f.

The circuit D generates a signal which is a measure for the average value of the product of the instantaneous value of the substantially square-wave voltage Vp and the accompanying instantaneous value of the current J. This signal is a measure for the average value of the power consumed by the lamp and acts as a first signal in this embodiment. In circuit E, a control signal is generated which is a measure for the difference between the first signal and a reference signal which is a measure for the desired average value of the power consumed by the lamp. This control signal is present at the input of drive circuit F. By means of the control signal, the drive circuit F adjusts the drive signal in such a way that the average value of the power consumed by the lamp is substantially equal to the desired value. The average value of the power consumed by the lamp may be controlled by means of the drive signal in that the conduction times of the two switching elements and/or the frequency f are controlled.

In a practical embodiment of the circuit arrangement shown in FIG. 2, the current sensor SE was a resistor of approximately 0.5 Ohm. The frequency f was approximately 28 kHz. It was found to be possible to operate lamps of widely differing power ratings and/or gas fillings by means of this practical embodiment of the circuit arrangement. During this, the power consumed by the lamp did not vary by more than 5% from lamp to lamp.

FIG. 3 shows a preferred embodiment of the circuit D.

In FIG. 3, reference numerals 3, 4 and 5 denote connection terminals of a multiplier circuit I. Terminal 3 is intended for connection to one side of the current sensor SE which coincides with an end of the load circuit. Terminal 4 is intended for connection to a further side of the current sensor SE. Terminal 5 is intended for connection to a further end of the load circuit B.

If the preferred embodiment of the circuit D is connected to an operating DC-AC converter, a voltage which is proportional to the instantaneous value of the current through the current sensor SE is present between the terminals 3 and 4. A voltage which is proportional to the instantaneous value of the voltage between the ends of the load circuit B is present between the terminals 3 and 5.

If the current sensor is not positioned in the load circuit B in such a way that one side of the current sensor forms an end of the load circuit B, i.e. different from what is shown, for example, for the embodiment in FIG. 2, it is necessary to provide the circuit D with four connection terminals for connection to the two ends of the load circuit B and the two sides of the current sensor.

At an output of the multiplier circuit I there is a signal Q which is proportional to the product of the instantaneous value of the voltage between the ends of the load circuit B and the instantaneous value of the current through the current sensor SE.

The output of the multiplier circuit I is connected to an input of a circuit II for generating a signal which is proportional to an average value of the signal Q. The signal which is proportional to an average value of the signal Q is present at output terminal 6 of circuit II and is suitable for functioning as a first signal proportional to the lamp power.

We claim:

1. A discharge lamp control circuit arrangement for operating a discharge lamp, comprising a DC-AC converter provided with a circuit A suitable for being connected to a DC voltage source, comprising two switching elements for generating a current with alternating polarity by being alternately conducting and non-conducting with a frequency f, a load circuit B comprising lamp connection terminals, inductive means, and ends which are each connected to a respective main electrode of one of the two switching elements in circuit A, a drive circuit F for generating a drive signal for rendering the switching elements alternately conducting and non conducting with the frequency f, and a current sensor, and a control circuit C coupled to the current sensor and to the drive circuit F for controlling a power consumed by the lamp, characterized in that the current sensor forms part of the load circuit B and the control circuit C is furthermore coupled to the ends of the load circuit B.

2. A circuit arrangement as claimed in claim 1, characterized in that the control circuit C comprises a multiplier circuit for generating a signal Q which is proportional to the product of an instantaneous value of a current through the current sensor and an accompanying instantaneous value of a voltage between the ends of the load circuit B, and a circuit for generating a signal which is proportional to an average value of the signal Q.

* * * * *